343-909 SR
4/7/87 OR 4,656,487

United States Patent [19]

Sureau et al.

[11] Patent Number: 4,656,487

[45] Date of Patent: Apr. 7, 1987

[54] ELECTROMAGNETIC ENERGY PASSIVE FILTER STRUCTURE

[75] Inventors: Jean-Claude Sureau, Boston; Janice M. Leibinger, Marlborough, both of Mass.

[73] Assignee: Radant Technologies, Inc., Stow, Mass.

[21] Appl. No.: 766,544

[22] Filed: Aug. 19, 1985

[51] Int. Cl.[4] ..... H01Q 15/02

[52] U.S. Cl. ..... 343/909; 343/872

[58] Field of Search ..... 343/756, 781 P, 909, 343/872

[56] References Cited

U.S. PATENT DOCUMENTS

| | | | |
|---|---|---|---|
| 3,148,370 | 9/1964 | Bowman | 343/909 |
| 4,126,866 | 11/1978 | Pelton | 343/909 |
| 4,342,035 | 7/1982 | Anderson et al. | 343/781 P |

OTHER PUBLICATIONS

Arnaud et al, Resonant-Grid Quasioptical Diplexer Electronics Letters, 13th. Dec. 1973, vol. 9, No. 23, pp. 589–590.

*Primary Examiner*—Eli Lieberman
*Assistant Examiner*—Doris Johnson
*Attorney, Agent, or Firm*—Robert F. O'Connell

[57] ABSTRACT

A structure for selectively transmitting electromagnetic energy therethrough which comprises a relatively thin insulative substrate having front and rear surfaces. The surfaces each have a pattern of regions thereon in each of which a first metallized Jerusalem cross is formed. In each region additional metallized Jerusalem crosses are formed in each of the quadrants of the first Jerusalem cross. The dimensions of the Jerusalem crosses on each surface are selected to provide suitable transmission resonances so as to permit transmission of electromagnetic energy through the surface over a selected portion of the frequency spectrum and to prevent transmission outside said portion of the spectrum.

10 Claims, 7 Drawing Figures

ELECTROMAGNETIC ENERGY PASSIVE FILTER STRUCTURE

INTRODUCTION

This invention relates generally to structures, such as radome structures, for permitting the selective transmission of electric energy therethrough and, more particularly, to a passive filter structure which permits the transmission of energy therethrough only over a selected frequency range.

BACKGROUND OF THE INVENTION

It is desirable in many applications to provide a structure, such as a radome structure, which will permit the transmission of energy, in either direction therethrough, only over a selected frequency range. For example, such a structure may be used to transmit energy only at relatively low RF (radio frequency) frequencies while preventing transmission at high RF frequencies, the range of high frequency opaqueness being preferably extended over as broad a range of the spectrum as possible. Such structures are normally desired to be energy reflective over such non-transmission energy range as opposed to being absorptive of the energy involved. Such behavior is generally referred to as "low pass band" behavior since it can be considered analogous to electrical filter circuitry with similar properties.

It has been suggested in the past that to achieve low pass behavior such structures use electrically insulative substrate layers, or sheets, having metalized patterns, sometimes referred to as metalized patches, placed thereon normally in a regularized pattern having selected patch dimensions and spacings and having selected shapes for the particular applications in which they are to be used. For example, the metalized patches may be square or circular in shape or may be in the form of multiple patch "window frame" configurations each multiple patch, for example, containing four symmetrically arranged subpatches to form each of the window patch metalized regions.

One of the problems with such designs is that in many cases they do not provide sufficient coverage in the frequency domain for the desired reflective behavior and often tend to vary excessively in their behavior with both the angle of incidence and the polarization of the radiation impinging thereon.

It is desirable, therefore, to achieve low pass filter type operation for such energy transmitting structures which will provide sufficient suppression of energy transmission therethrough over a wide portion of the frequency spectrum and will produce the desired low pass filter operation over a wide range of incidence angles and for various polarizations of the impinging energy. Moreover it is desirable in some applications that the desired low pass behavior have its performance maximized utilizing only a single thin substrate layer rather than by using multiple layer as proposed in previously used structures, particularly for those applications in which the physical constraints thereof demand that the material thickness be kept to a minimum.

BRIEF SUMMARY OF THE INVENTION

In accordance with the invention, a structure is provided which utilizes a single, relatively thin, dielectric substrate having multiple resonant elements or regions, positioned on the front and rear surfaces thereof so as to provide low pass operation (at the low end of the frequency spectrum) and so as to achieve a relatively broad range of energy suppression over the remainder of the frequency spectrum. In such a structure, selected metalization patterns are provided on both sides of the substrate, each side including a composite of at least two different size patterns for producing the multiple resonant operations desired. In a preferred embodiment, for example, at least four different definable elements which differ at least in size and may also differ in shape or periodicity can be utilized for each of the metalization pattern regions exhibiting a reflective resonance, when isolated, within the frequency range in which the overall surface is desired to be reflective.

In an exemplary preferred embodiment the geometric metalization configurations are based on the use of a cross potent, sometimes referred to as a Jerusalem Cross, configuration in which two different size crosses are utilized in each major metalization region. For example, such a region may use a single, large Jerusalem Cross configuration effectively having within its quadrants four smaller Jerusalem Cross configurations so as to form a particular region which can be periodically reproduced on the surface to provide an overall pattern on each side of the substrate. For example, in a preferred embodiment the ratio of the dimensions of the larger crosses to the smaller crosses is selected so as to be substantially the same for the patterns on each side of the substrate while the sizes of the crosses on one side of the substrate are preferably different from the sizes thereof on the other side, thereby producing different reflective resonances over the desired portion of the frequency spectrum in which transmission is to be prevented. In such a particular embodiment a total of potentially four distinct primary resonances can be created for such transmission suppression characteristics. However, at sufficiently low frequencies the patterns created tend to be substantially transparent to incident radiating energy due to the capacitive nature of the individual metalization patterns involved.

BRIEF DESCRIPTION OF THE INVENTION

The invention can be described in more detail with the help of the accompanying drawings wherein.

Figure 1:
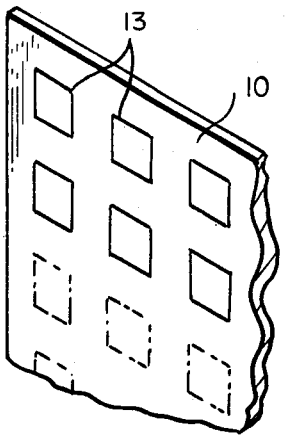
FIG. 1 PRIOR ART
FIGS. 1, 1A and 1B shows various metalization patterns as suggested by the prior art.
Figure 1A:
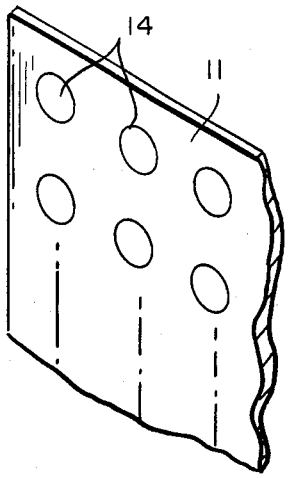
FIG. 1A PRIOR ART
Figure 1B:
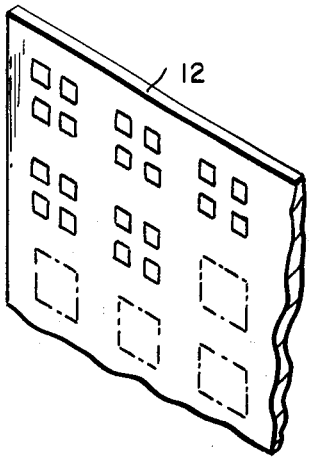
FIG. 1B PRIOR ART

As can be seen in FIGS. 1, 1A, and 1B, portions of substrates 10, 11 and 12, respectively, as proposed by the prior art for use in producing low pass structures are depicted. In FIG. 1, substrate 10 which is a suitable insulative or dielectric material, such as Teflon®, has positioned on one side thereof a periodic pattern of metalized regions 13 which have square configurations. Such square metal patches are utilized only on one surface of the substrate and an overall filter structure is formed by the use of a plurality of layers, or substrates, of the type shown in FIG. 1 placed adjacent one another with appropriate spacing elements (such as plastic honeycomb structures) positioned therebetween. The selection of the spacing, the number of layers and the overall thickness of the multi-layered structure provides a measure of control over the desired frequency characteristics so as to provide for energy transmission through the filter structure over a particular portion of the frequency spectrum and so as to prevent energy transmission over the remainder of the frequency spectrum.

Alternate patch configurations are shown in FIGS. 1A and 1B wherein each of the metalized regions 14 is shown as a single circular patch (FIG. 1A) or in the form of groups, or windows, 15 of four smaller square patches, for example, (FIG. 1B). Multi-layer panels must then be used in each case to form an effective overall filter structure.

Because such structures have to formed as multi-layered structures, the thickness thereof may make them unusable in applications in which the physical constraints of the application demand that the thickness of the overall structure be kept to a minimum. Moreover, such structures tend to operate only within a relatively narrow range of incidence angles of the impinging electromagnetic energy radiation and normally are effective only for a particular polarization of such incoming energy.

Figure 2:
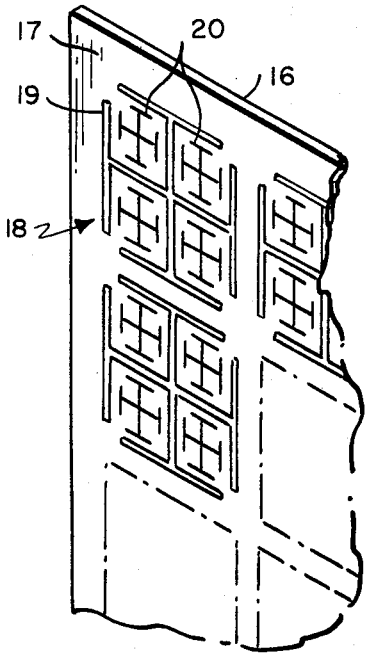
FIG. 2 depicts periodic patterns of metalization regions on one surface of a substrate in accordance with a particular embodiment of the invention.

A structure in accordance with the invention is shown in FIG. 2 wherein a substrate 16 has on one side 17 (for convenience referred to as the "front" side) a plurality of metalized regions 18 formed in a periodic fashion thereon. Each of the metalized regions for a particular embodiment is exemplarily shown in more detail in FIG. 3 and, as can be seen in both figures, each region has a first relatively large metalized cross configuration in the form of a cross potent, or Jerusalem Cross, 19. A further metalized Jerusalem Cross 20 of a smaller configuration is positioned within each quadrant thereof, as shown. On the front side of the substrate the two different size cross configurations are arranged so as to have a selected ratio of dimensions which in a particular embodiment, for example, may be roughly in a 2:1 ratio. Each cross pattern, if isolated, would produce a reflective suppression resonance characteristic, that is, it would suppress the transmission through the substrate of electromagnetic energy radiation incident thereon over a selected range of the frequency spectrum. Thus, if only a pattern of the larger crosses were utilized, in isolation, a particular energy reflective resonance characteristic would be provided, while if only a pattern of the smaller crosses were utilized, in isolation, such pattern would produce a different reflective resonance characteristic generally directed toward a different range of the frequency spectrum.

In addition to the two different cross configurations utilized on the front side of substrate 16, the reverse side thereof (not shown) also has positioned thereon a plurality of metalized regions generally similar to those on the front side, i.e., a large Jerusalem Cross having a plurality of smaller Jerusalem Crosses within each quadrant thereof.

In a preferred embodiment the dimensions of the crosses in the pattern on the reverse side is about one and one-half those of the crosses in the pattern on the front side. Preferably the ratio of the dimensions of the large to small crosses on the reverse side remains approximately 2:1, as on the front side. As on the front side, each of the Jerusalem Cross patterns, in isolation, on the reverse side, provides suppression resonance characteristics over still other portions of the frequency spectrum which are different from each other and from those on the front side. The use of all such patterns on each side of the substrate in the particular embodiment disclosed provides a potential total of four primary suppression resonances that can be created.

At sufficiently low frequencies, i.e., over the desired "low pass" band of the frequency spectrum, the overall structure tends to be transparent to the transmission of electromagnetic energy (i.e., no reflection or absorption of energy at such frequency range would occur) which low pass configuration is due to the capacitive nature of the individual metalization patterns used. In such a case the patterns tend to appear to the impinging energy as capacitances having values which would not block the transmission of such energy at such low frequencies, either through reflective or absorptive operations.

It has also been found that while there is inherent mutual coupling between each of the resonant pattern configurations, such coupling does not tend to alter the individual resonance characteristics thereof and the overall multiple configuration pattern tends to provide relatively broad suppression of the transmission of incident energy at frequencies above the low pass band so that substantially little or no transmission of energy over a wide portion of the frequency domain up to as high as 20 gigahertz (GHz) can be provided in particular applications. Moreover, it has been found that the use of such a structure provides good pass band and suppression band characteristics even over relatively wide angles of incidence of the electromagnetic energy which impinges on the structure and even for various polarizations of the incoming electromagnetic energy.

The basic substrate sheet, or layer, can be fabricated, for example, by using photoetching techniques for the metalization patterns on both sides of the substrate, in a manner which would be known to those in the art. In a particular embodiment, for example, such substrate may be a relatively thin, e.g., 5 mil, doubly-clad plastic material one type of which is available under the designation G10 from TRISTAR Corporation of Worcester, Mass. Other available substrate materials such as Teflon ®, as mentioned above, can be used.

Figure 3:
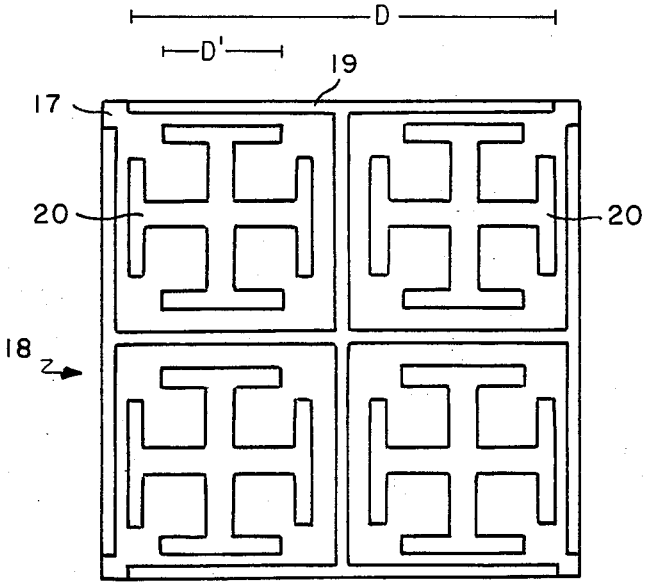
FIG. 3 depicts in more detail a basic metalization region used in the pattern thereof in FIG. 2.

In a particular example such as shown in FIG. 3 using a dual-sized Jerusalem Cross pattern, a typical ratio of dimensions is approximately 2:1 on the both sides while the ratio of the dimensions of the crosses on the reverse side to those on the front side is approximately 1.5:1, as mentioned above. Thus, in the symmetrical pattern shown the ratio can be exemplified, for example, in that the distance D to the distance D' represents approximately the desired ratio, the remaining dimensions being selected proportionately.

Figure 4A:
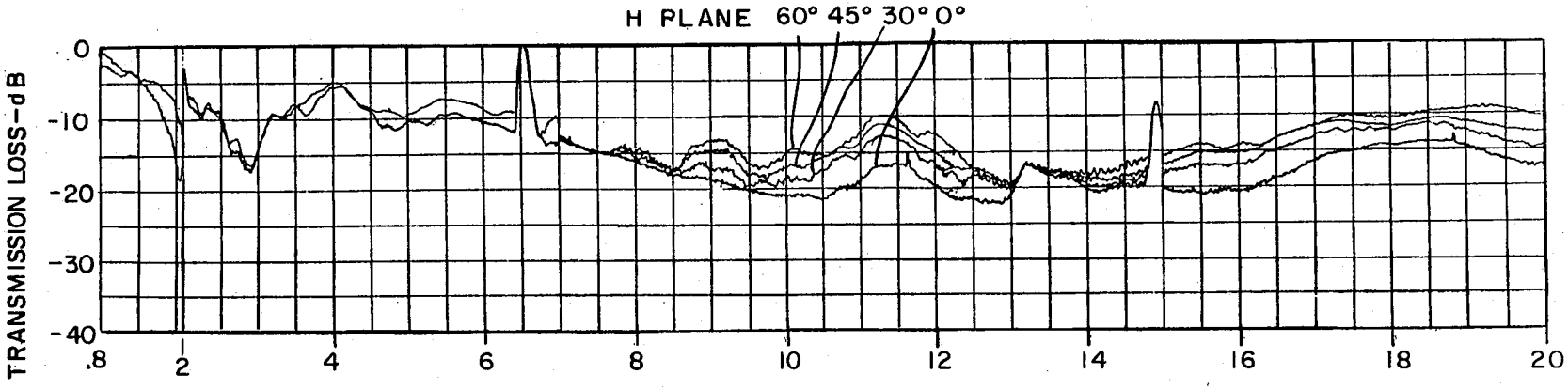
FIGS. 4 and 4A show exemplary electromagnetic wave energy transmission characteristics using a structure of the type shown in FIGS. 2 and 3 for both the E-Plane and the H-Plane components of the electromagnetic energy waves.
Figure 4:
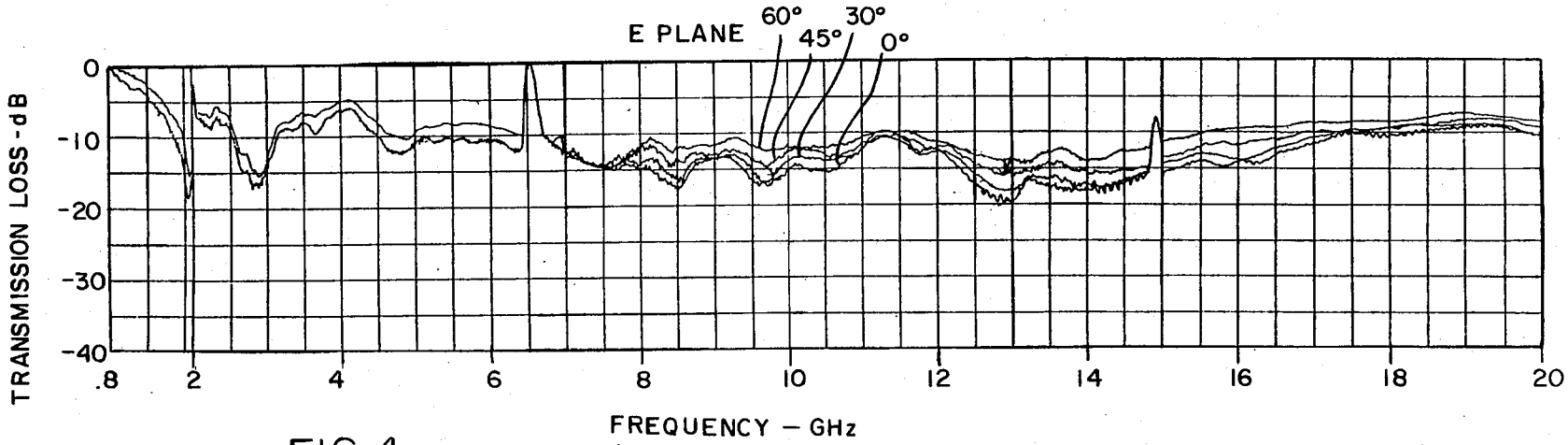

In any particular embodiment those in the art can determine the absolute dimensions that are required for particular low pass and suppression resonant operations desired in an empirical fashion. A particular embodiment of the invention that has been successfully fabricated for such purpose has produced a frequency pass band characteristic, as depicted in FIGS. 4 and 4A, wherein the transmission loss as a function of frequency is shown for both the E-Plane and the H-Plane. The curves show responses for various incidence angles, ranging from 0° (defined as normal, or orthogonal, to the surface) to approximately 60° (off the normal), which can be responded to by the structure. The individual resonances of the four cross configuration patterns mutually interact so that they are not clearly distinguishable in the frequency response spectrum but tend to have an overall 'smeared' response characteristic. In the specific responses depicted, the anamolous responses at approximately 6.5 GHz and 15.0 GHz are due to the limitations of the equipment used to make the measurements in this specific instance.

Over a relatively wide range of frequencies, which in the particular embodiment shown ranged from 2 to 20 GHz, the structure had a sufficiently high transmission loss (i.e., high reflectivity) to make it useful for a variety of applications. For example, the structure may be used to reduce mutual interferences or other interactions between one (or several) low frequency sensors and one (or several) high frequency sensors. In such an application, for example, the low frequency sensor can be encapsulated, or otherwise covered or enclosed by the substrate and metalized material structure discussed above in order to provide low electromagnetic energy transmission only at the low end of the frequency band and to prevent such energy from being transmitted in either direction above said low pass band.

While the particular embodiment shown and discussed above has proven to be useful in many applications, modifications thereto may occur to those in the art within the spirit and scope of the invention. Hence the invention is not to be limited to the particular embodiment disclosed except as defined by the appended claims.

What is claimed is:

1. A structure for selectively transmitting electromagnetic energy within a selected frequency range and for preventing the transmission of electromagnetic energy outside said selected frequency range, said structure comprising an insulative member having first and second surfaces, each of said surfaces having a plurality of regions formed in a selected pattern thereon;

each of said regions having a metallized portion in the configuration of a first Jersusalem cross having four quadrant regions therein, each of said quadrant regions further having a metallized portion in the configuration of a second Jerusalem cross, the dimensions of the first Jerusalem cross and the dimensions of the second Jerusalem cross in each of said regions having a selected ratio and the dimensions of the first and second Jerusalem crosses on the regions of the first surface being different from the dimensions of the first and second Jerusalem crosses on the regions of the second surface.

2. A structure in accordance with claim 1 wherein the selected patterns on each said surface are symmetrically arranged thereon.

3. A structure in accordance with claim 1 wherein said selected ratio is about 2:1.

4. A structure in accordance with claim 3 wherein the dimensions of the first and second Jerusalem crosses on the second surface are larger than those on the first surface.

5. A structure in accordance with claim 4 wherein the dimensions of the first and second Jerusalem crosses on the second surface are about 1.5 times larger than those on the first surface.

6. A structure in accordance with claim 1 wherein the dimensions of the Jerusalem crosses on each of said surfaces are each selected to produce a transmission resonance frequency at a different region of the frequency spectrum whereby transmission of electromagnetic energy through said structure occurs over a first selected portion of the frequency spectrum and transmission through said structures outside said selected portion of the frequency spectrum is substantially prevented.

7. A structure in accordance with claim 6 wherein said dimensions are selected so that transmission occurs at the low end of the frequency spectrum and said structure acts as a low pass filter.

8. A structure in accordance with claim 1 wherein said structure is an insulative substrate structure having said first and second surfaces.

9. A structure in accordance with claim 8 wherein said insulative substrate has a thickness of about 5 mil.

10. A structure in accordance with claim 8 wherein said insulative substrate is a doubly-clad plastic material.

* * * * *